United States Patent [19]

Tsushima et al.

[11] 4,443,095

[45] Apr. 17, 1984

[54] IMAGE TRANSFER AND SHEET SEPARATION APPARATUS FOR ELECTROPHOTOGRAPHIC SYSTEM

[75] Inventors: Shuichi Tsushima; Fuyuhiko Matsumoto, both of Tokyo, Japan

[73] Assignee: Ricoh Company, Ltd., Tokyo, Japan

[21] Appl. No.: 374,653

[22] Filed: May 3, 1982

[51] Int. Cl.[3] ..... G03G 15/01; G03G 15/14

[52] U.S. Cl. ..... 355/14 R; 355/14 TR; 355/3 TR; 355/4

[58] Field of Search ..... 355/14 TR, 3 TR, 3 CH, 355/14 CH, 4, 14 R, 3 R

[56] References Cited

U.S. PATENT DOCUMENTS

| | | | |
|---|---|---|---|
| 4,077,709 | 3/1978 | Borostyan et al. | 355/3 TR |
| 4,220,699 | 9/1980 | Ishida et al. | 355/3 TR |
| 4,341,456 | 7/1982 | Iyer et al. | 355/3 TR |
| 4,348,098 | 9/1982 | Koizumi | 355/3 TR |
| 4,367,032 | 1/1983 | Sakamoto | 355/3 TR |

*Primary Examiner*—Richard L. Moses

*Attorney, Agent, or Firm*—David G. Alexander

[57] ABSTRACT

In an electrophotographic system in which latent images of negative and positive polarities formed electrostatically on a photoconductive member or a dielectric member are successively developed with two different kinds of toners and then transferred onto a transfer medium, an image transfer and sheet separation apparatus comprises a precharger for uniformalizing the different polarities of the toners carried on the photoconductive member or the dielectric member, a transfer charger for transferring the toners onto the transfer medium, and a conductive member for image transfer and sheet separation located to become intimately engaged by the transfer medium and provided with means for applying a voltage.

26 Claims, 7 Drawing Figures

IMAGE TRANSFER AND SHEET SEPARATION APPARATUS FOR ELECTROPHOTOGRAPHIC SYSTEM

BACKGROUND OF THE INVENTION

The present invention relates to an image transfer and sheet separation apparatus for use in an electrophotographic system or the like to permit a toner image to be transferred onto a sheet of paper or like medium to a significant efficiency while, at the same time, causing the transfer medium to readily become separated from a photoconductive member, a dielectric member or like latent image supporting member. Further, the present invention is concerned with an image transfer and sheet separation apparatus for use in a two-color electrophotographic copying system or the like which develops latent images of positive and negative polarities with positively charged and negatively charged two kinds of toners, transfers the toner images to a transfer medium and separates the transfer medium from a latent image supporting element.

Ever increasing attention has been paid to a two-color electrophotographic process in which electrostatic latent images charged to the opposite polarities are developed by toners of two different colors. In this type of process, a positive latent image is developed by a negatively charged red toner and a negative latent image by a positively charged black toner, whereafter the toner images are transferred onto a paper sheet or like transfer medium and, then, the sheet is separated from a dielectric member, a photoconductive member or like latent image supporting element.

Various methods have heretofore been proposed to form the positive and negative latent images in the two-color electrophotography: a method using styluses to deposite positive and negative charges on a dielectric member, a method charging individual photoconductive layers, which are stacked together and have different spectral sensitivities, to the positive and negative polarities and, thereby, forming positive and negative latent images by one exposure to image light, a method using a photoconductive member on which a photoconductive layer and an insulating layer are stacked successively, a method which charges a photoconductive member to $V_s$ volt, for example, a background area potential to about $\frac{1}{2}\cdot V_s$ volt by laser or like means, one video data to $V_s$ volt and the other video data to about 0 volt. Although the last-mentioned method does not provide positive and negative latent images in a strict sense, it may be included in the class of positive-negative latent image forming methods taking the background potential as a criterion.

Known methods for simultaneous transfer of positive and negative toner images may generally be classified as: one which precharges them to a common polarity before an image transfer and then transfers them by corona charge, and one which after the precharging, causes a charged insulating member or a conductive member impressed with a voltage to contact a transfer medium from the back. The former method is relatively simple and convenient. However, supposing that the polarity of the precharge is positive, the former method fails to efficiently transfer the toner originally charged to the negative and, particularly, causes local omission of transfer in a relatively wide image area, which is critical to the reproduction of quality images. The latter method, on the other hand, renders the separation of a transfer medium from a photoconductive element unstable though superior to the former concerning the quality of images.

Meanwhile, various methods and apparatuses are known to the art for separating a paper sheet or like transfer medium from a latent image supporting member of the kind described. The sheet separation, however, involves problems which are very difficult to solve. In a method in commercially extensive use today, a paper sheet undergone an image transfer has its leading end subjected to AC corona charge to have the charge thereon neutralized and, then, a pawl or like separator means located adjacent a photoconductive member forcibly removes the sheet which is now easily separable due to the neutralized charge. A drawback inherent in this method is that the AC corona charge disturbs an image adjacent the sheet leading end while the pawl also tends to disturb the image or even to damage the photoconductive member. In another known method, after a transfer by corona charge, a conductor which is grounded is brought into contact with a paper sheet from the back to separate a leading end portion of the sheet, whereafter the conductor is impressed with a voltage. This is neither acceptable because an image in the leading end portion of the sheet would become lower in density or entirely omitted. While a paper sheet may be separated by air suction as has also been proposed, this not only fails to stably separate the sheet but generates noise due to the suction.

Means for efficiently transferring a toner of a single polarity and separating a transfer member stably from a photoconductive member is also available in various forms. However, none of them is satisfactory for all the modes of operation designed for an electrophotographic copying machine. Indeed, there has been proposed in connection with an electrophotographic copying machine or the like, which is operable in various modes, to selectively activate individual units or elements of the machine or to change the voltages or polarities depending on the operation mode. This, however, is reflected by the intricacy of construction of the entire apparatus, higher production cost, lower reliability and other various drawbacks.

SUMMARY OF THE INVENTION

An image transfer and sheet separation apparatus for an electrophotographic system embodying the present invention comprises a photoconductive member on which a latent image is to be formed electrostatically, developing means for developing the latent image with a toner into a toner image, a transfer charging means for transferring the toner image onto a transfer medium; a precharging means located between the developing means and the transfer charging means, and a conductive member so positioned as to be intimately engaged by the transfer medium.

In accordance with the present invention, in an electrophotographic system in which latent images of negative and positive polarities formed electrostatically on a photoconductive member or a dielectric member are successively developed with two different kinds of toners and then transferred onto a transfer medium, an image transfer and sheet separation apparatus comprises a precharger for uniformalizing the different polarities of the toners carried on the photoconductive member or the dielectric member, a transfer charger for transferring the toners onto the transfer medium, and a conductive member for image transfer and sheet separation located to become intimately engaged by the transfer medium and provided with means for applying a voltage.

It is an object of the present invention to provide a new image transfer and sheet separation apparatus for an electrophotographic system or the like which markedly improves the efficiency of toner image transfer onto a transfer medium and promotes ready separation of the transfer medium from a latent image supporting member.

It is another object of the present invention to provide a new image transfer and sheet separation apparatus which, after latent images of negative and positive polarities have been developed by two kinds of toners charged to the positive and negative, respectively, transfers the toner images onto a transfer medium and then readily separates the transfer medium from a latent image supporting member.

It is another object of the present invention to provide means for reproducing an image optimum for a desired kind of video data, an apparatus which is commonly conditioned for image transfer and sheet separation throughout various operation modes, and an apparatus which is operated under variable conditions for transfer and separation to achieve a favorable result.

It is another object of the present invention to provide a generally improved image transfer and sheet separation apparatus for an electrophotographic system.

Other objects, together with the foregoing, are attained in the embodiments described in the following description and illustrated in the accompanying drawing.

DESCRIPTION OF THE PREFERRED EMBODIMENTS

While the image transfer and sheet separation apparatus for an electrophotographic system of the present invention is susceptible of numerous physical embodiments, depending upon the environment and requirements of use, substantial numbers of the herein shown and described embodiments have been made, tested and used, and all have performed in an eminently satisfactory manner.

Figure 1:
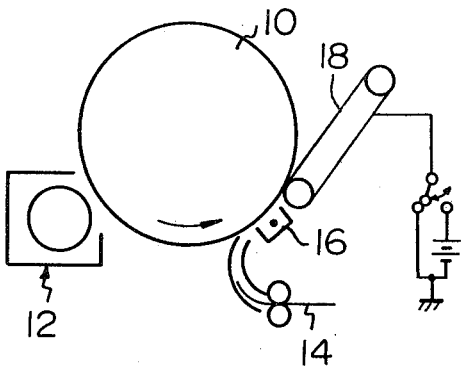
Fig. 1 PRIOR ART
FIG. 1 is a schematic view of an electrophotographic copying system with a prior art image transfer and sheet separation apparatus.

Referring to FIG. 1 of the drawings, a prior art apparatus for image transfer and sheet separation is schematically illustrated and which is of the type using a conductor in the form of a belt. A photoconductive drum 10 serves as a latent image supporting member which supports an electrostatic latent image thereon. A developing unit 12 processes the latent image into a toner image which is then transferred onto a transfer medium in the form of a sheet of paper 14 by a corona charger 16 from the back face of the paper sheet 14. The paper sheet 14 with the toner image is separated from the drum 10 by a conductive belt 18.

Figure 2:
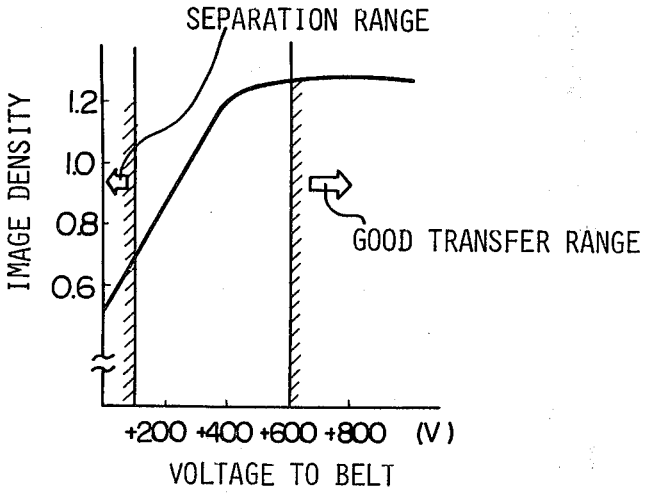
FIG. 2 is a graph representing a result of experiments conducted with the apparatus of FIG. 1.

The density of an image transferred to the paper sheet 14 is largely affected by a voltage which is supplied to the conductive belt 18 for sheet separation. A series of experiments we carried out for determining a relationship between the image density and the voltage resulted a curve shown in FIG. 2. As seen in FIG. 2, when the voltage applied to the belt 18 was +600 V or higher, the paper sheet 14 remained in intimate contact with the drum 10 without being separated though the image quality was favorable. It was revealed that a voltage of +100 V or lower succeeds in separating the paper sheet 14 from the drum 10 but at the sacrifice of the image density, as also understood from the curve of FIG. 2. An expedient for settling this problem may be a system in which the belt 18 is grounded upon arrival of the leading end of the paper sheet 14 in between the drum 10 and the belt 18 and, then, it is impressed with a voltage of +600 V or higher as the paper sheet 14 further advances 5–10 mm. This expedient is still disadvantageous in that an image cannot be fully transferred onto a leading end portion of the paper sheet with the resultant decrease in image density which might lead to entire omission of the image.

The present invention overcomes such a drawback and reproduces quality images using a precharger located just ahead of the transfer station with respect to the direction of rotation of the drum 10. A voltage opposite in polarity to a transfer charger is supplied to a conductive member which may be in the form of a drum or a roller.

Figure 3:
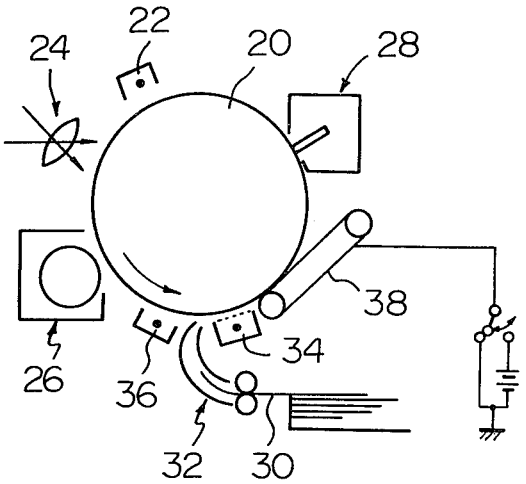
FIG. 3 is a schematic view of an image transfer and sheet separation apparatus embodying the present invention.

Referring to FIG. 3, an image transfer and sheet separation apparatus embodying the present invention is shown. The apparatus is applied to an ordinary electrophotographic copying machine which provides white-black copies by way of example. The copying machine includes a photoconductive drum 20 around which a preliminary corona charger 22 for exposure, an imaging system 24, a developing unit 26 and a cleaning unit 28 are arranged in succession. A sheet of paper 30 is directed to between the drum 20 and a transfer corona charger 34 by a guide 32 which is a known guide means. In accordance with this embodiment, a preliminary corona charger 36 is positioned between the developing unit 26 and the transfer charger 34 in order to deposite a uniform electrostatic charge on the surface of the drum 20 and the toner carried on the drum surface. While the voltage applied to the precharger 36 and the subsequent transfer charger 34 may be either positive or negative, it is necessary that the voltage fed to the conductive belt 38 be opposite in polarity to the voltage fed to the transfer charger 34.

The arrangement shown in FIG. 3 will be described in more detail in connection with Example I and comparative Example I.

EXAMPLE I

Figure 4:
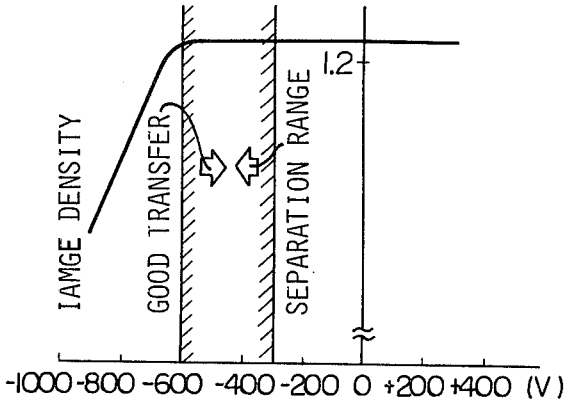
FIG. 4 is a graph demonstrating Example I which used the apparatus indicated in FIG. 3.

A latent image was electrostatically formed with a voltage of +600 V on the drum 20 which was covered with a 60 μm selenium layer. The latent image was developed by a developer FT 6600 (Ricoh Co. Ltd., Japan) for use in electrophotographic copying machines and, thereupon, a voltage of −5.0 kV was fed to the precharger 36 to charge the periphery of the drum 20. Then, the transfer charger 34 was impressed with a voltage of +5.5 kV to transfer the toner onto a paper sheet 30 while depositing a positive charge on the sheet 30. The sheet 30 carrying the toner image was advanced to between the drum 20 and the belt 38. Where the belt 38 and drum 20 were engaged with each other over a width of 5 mm, the voltage fed to the belt 38 and the image density were found to have an interrelation shown in FIG. 4. As shown in FIG. 4, good image transfer occurred when the voltage was −600 V or higher while stable sheet separation occurred when the voltage was −300 V or lower. Thus, both the conflicting needs for good image quality and stable sheet separation were satisfied when the belt 38 was impressed with a voltage ranging from −600 V to −300 V.

COMPARATIVE EXAMPLE I

A copying cycle was performed under exactly the same conditions as in Example I up to the developing step. The precharger 36 ahead of the charger 34 was absent in the arrangement used, as in the prior art apparatus shown in FIG. 1. For a common voltage applied to the transfer charger 34 (or 16 in FIG. 1), the voltage fed to the belt 38 (or 18 in FIG. 1) was related with the image density and sheet separability as represented by a curve in FIG. 2. That is, as previously mentioned, the higher the separability, the lower the transferability became or vice versa, due to the different conditions adequate for sheet separation and image transfer.

It will be seen that the arrangement in Comparative Example I must be furnished with additional means for lowering the voltage supply to the belt (down to 0 V, for example) for the leading end portion of the paper sheet to facilitate sheet separation from the drum, while raising the voltage supply to the belt thereafter to increase the transfer efficiency. This not only adds to the intricacy of construction and cost but significantly degrades the image quality in a leading end portion of the paper sheet.

The arrangement shown in FIG. 3 reproduces a favorable image throughout the surface of a paper sheet overcoming the shortcomings stated above, due to the presence of the precharger 36 and the supply of a voltage to the belt 38 opposite in polarity to the voltage supply to the charger 34.

Experiments also revealed that a transfer charger 34 having a grid electrode between its charge wire and the drum 20 is effective to further improve the quality of images transferred to paper sheets. Whereas a transfer charger 34 without a grid electrode allowed an image of a relatively wide area to be locally omitted, the charger 34 with a grid provided an image without any omission or like deterioration despite such a large image area.

While the voltage supplied to the precharger 36 has been described as being positive or negative in polarity as desired, it is preferably be of the same polarity as the charge on the toner. Should the voltage to the precharger 36 be different in polarity from that of the toner charge, the toner particles on the drum 20 might fly toward the charge wire to contaminate it.

Figure 5:
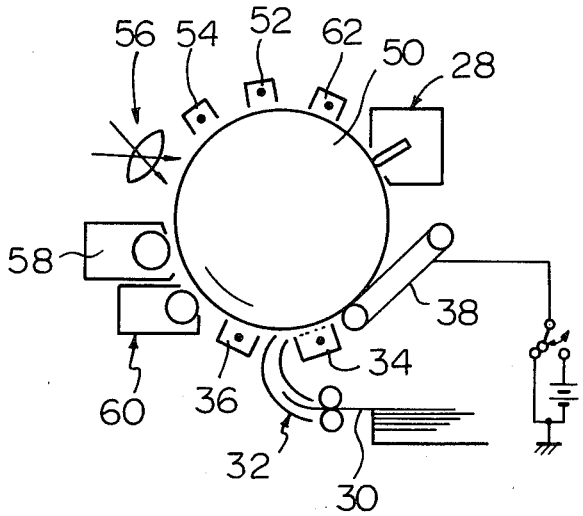
FIG. 5 is a schematic view of an electrophotographic copying system equipped with an image transfer and sheet separation apparatus of the present invention.
Figure 6:
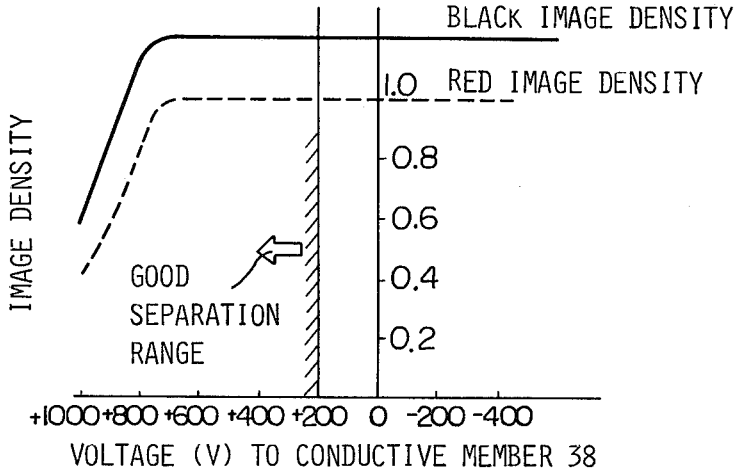
FIG. 6 is a graph indicating a relationship between a voltage supplied to a conductive member and an image density and sheet separability provided by Examples II and III which are concerned with the embodiment of FIG. 5.
Figure 7:
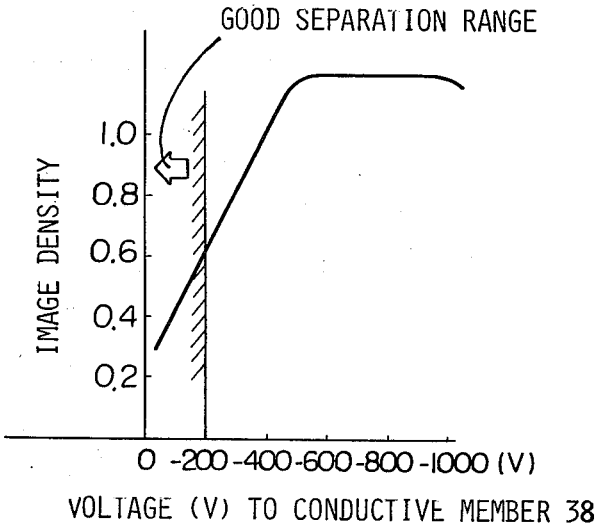
FIG. 7 is a graph showing a relationship between a voltage fed to a conductive member and an image density and sheet separability provided by Example IV also concerned with the embodiment of FIG. 5.

Referring to FIGS. 5–7, another embodiment of the present invention will be described which is applied to a two-color electrophotographic copying machine. In FIGS. 5–7, the same parts and elements as those shown in FIG. 3 are denoted by the same reference numerals.

As shown, the copying apparatus for two-color reproduction includes a photoconductive drum 50 around which are arranged a positive charger 52, a negative charger 54, an imaging system 56, a red-black developing unit 58, a precharger 36, a guide 32 for guiding a paper sheet 30 during its movement, a charger 34, a conductive belt 38 with voltage supply means, a cleaning unit 28 and an AC discharger 62. The arrangement shown in FIG. 5 is characterized by the combination of (a) the precharger 36 for providing uniformity to the polarities of the negative and positive toners, (b) the transfer charger 34 for transferring the toners of the common polarity onto the paper sheet 30, and (c) the conductive belt 38 with the voltage supply means which transfers toner particles failed to be transferred by the charger 34 to the paper sheet 30 and separates the sheet 30 charged by the charger 34 from the drum 50. Such a combination realizes an excellent transfer and separation apparatus as will be discussed in detail hereinafter.

Referring to FIG. 5, the precharger 36 having the function described above is an element which is necessarily operated in a mode A which will be described. The uniform polarity which the precharger 36 is expected to deposite may be either positive or negative as desired; for example, the polarity of the red toner may be converted into the same polarity as the black toner, i.e. positive polarity. The transfer charger 34 should preferably apply a voltage opposite in polarity to the toners in view of its function of transferring the red and black toners with the same polarity to the paper sheet 30.

The conductive belt 38 serves to further enhance the transfer efficiency when supplied with a voltage. Another function of the belt 38 is to cause the paper sheet 30 charged by the precharger 34 to intimately contact therewith, allowing the paper sheet 30 to smoothly separate itself from the drum 50. Preferably, the conductive belt 38, or a conductive roller as may be desired, is rotated in synchronism with the drum 50 so as to convey the paper sheet 30 separated from the drum 50.

The conductive member 38 in the form of a belt or a roller may be formed of any desired material insofar as it can be substantially impressed with a voltage or electrically grounded. Typical examples may be a roller made of metal such as aluminum or iron, a roller or belt having a thin layer of metal such as aluminum on a plastic film such as polyester or polyimide, a belt or roller made of conductive rubber and a nickel belt formed by electrocasting.

The effects attainable with the embodiment shown in FIG. 5 will be described in conjunction with Examples II–IV and Comparative Examples II–IV.

EXAMPLE II

The drum 50 had an electroconductive layer on which were layed a first photoconductive layer of a specific conductive capacity of 7.6 and a thickness of 42 μm and a second photoconductive layer of a specific conductive capacity of 3.5 and a thickness 25 μm. The drum 50 was deposited with a negative latent image having a surface potential of −700 V and a positive latent image having a surface potential of +550 V. The negative and positive latent images were developed by a black toner charged to +15 μC/g and a red toner charged to −13 μC/g, respectively. For the subsequent image transfer and sheet separation, the precharger 36 was impressed with a voltage of +5.5 kV and the charger 34 a voltage of −5.0 kV. Under this condition, the transferability and separability were found to vary as shown in FIG. 6 depending on the magnitude of the voltage supplied to the belt 38. As seen in FIG. 6, the image density substantially remained constant with the transfer efficiency saturated at +700 V or lower voltages coupled to the belt 38. The separation efficiency on the other hand remained stable at +200 V or higher voltages coupled to the belt 38.

It was thus confirmed that a voltage supply to the belt 38 within the range of +200 V to +700 V not only promotes reproduction of images with favorable density but permits paper sheets to be stably separated from the drum 50.

If desired, the voltage fed to the belt 38 may be varied from a leading end portion of a paper sheet 30 to be rest of the same. In detail, since a leading end portion of the paper sheet 30 once separated from the drum 50 and sticked to the belt 38 does not return to the drum 50 any more, a voltage of +800 V may be selected for a leading end portion of the sheet 30 which is 5 mm wide, for example, in order to further enhance the separation efficiency and a voltage of +100 V for the rest of the sheet to promote stable image transfer.

In Example II, a charger 34 without a grid electrode caused local omission of a toner image particularly in a red image area where the polarity was inverted. This problem could be eliminated using a charger 34 with a grid electrode and controlling a voltage fed thereto.

COMPARATIVE EXAMPLE II

The same arrangement as for Example II was used except for the omission of the precharger 36. When the transfer charger 34 was supplied with a negative voltage and the belt 38 a positive voltage, the density of a black image was noticeably lowered. Reversing the polarities of voltages to the charger 34 and belt 38 caused a substantial drop of the density of a red image. When the transfer charger 34 and belt 38 were supplied with voltages of the same polarity, an image of one of the two different colors was hardly transferred onto a paper sheet 30 and the resultant sheet separability was very poor.

COMPARATIVE EXAMPLE III

The same arrangement as in Example II was used except for the omission of the transfer charger 34. When the voltages fed to the precharger 36 and belt 38 were opposite in polarity to each other, a paper sheet 30 did not become separated from the drum 50 at all and, thus, an additional means for separation was required though the image quality was comparable with one attained in Example II (a black image was rather poor).

COMPARATIVE EXAMPLE IV

The same arrangement as in Example II was used except for the omission of the belt 38. Under this condition, both the red image and black image were found quite poor in quality compared to the quality achieved in Example II. Moreover, another means for sheet separation had to be furnished with.

It will be apparent from the foregoing that the combination of the precharger 36, transfer charger 34 and belt 38 inherent in the embodiment shown in FIG. achieves a satisfactory effect.

EXAMPLE III

This Example is concerned with a transfer and separation apparatus of the type which uses positive and negative latent images to obtain video data contained in both or one of the two different latent images and is constructed to reproduce desired video data only. Such an apparatus may be operated in five different modes:

(1) a mode in which the positive and negative latent images are developed by two toners of different colors to produce data contained in the two latent images at the same time but in different colors (mode A) (2) a mode in which the latent images are developed by one of the toners, red or black, to produce only one data, which may be subdivided as (i) a mode for obtaining black image only (mode B)

(ii) a mode for obtaining red image only (mode C)

It is naturally needless to always form positive and negative latent images, but only a necessary polarity of latent image may be formed and developed in a single color.

(3) a mode in which two different video data are produced in a same color, which may be subdivided as (i) a mode for forming two video data with the positive or negative polarity during formation of latent images and, then, producing all the data in black (mode D)

(ii) a mode for forming two video data with the positive or negative polarity during formation of latent images and, then, producing all the data in red (mode E)

Though it is of course permissible to form positive and negative latent images and develop them with two different kinds of toners charged to the positive polarity and the negative polarity, as such can be included in the mode A since the toners are essentially common to those of the mode A.

In this way, Example III contemplates to selectively operate all or part of the basic combination of the precharger 36, transfer charger 34 and belt 38 in the five different modes or vary the operating conditions depending on the mode. Stated another way, the purport of Example III is to render the combination 63, 34, 38 operative and inoperative depending on the mode of operation thereby transferring images and separating sheets under conditions optimum for each operation mode.

Now, in Example III, a latent image of the positive polarity was developed with a red toner and a latent image of the negative polarity with a black toner as previously mentioned. In each of the different modes A–E, the individual elements 36, 34, 38 were controlled as tabulated below.

| MODE | TRANSFERRED TONER COLOR | OPERATION PRECHARGER 36 | CHARGER 34 | BELT 38 |
|---|---|---|---|---|
| MODE A | red | ON | ON | ON |
| | black | (positive) | (negative) | (positive) |
| MODE B | black | OFF | ON | ON |
| D | | | (negative) | (negative) |
| MODE C | red | OFF | ON | ON |
| E | | | (positive) | (positive) |

It should be born in mind that in the table shown above the polarities of each element are not limitative but only illustrative.

The mode A corresponds to Example II and, therefore, will not be described any further.

In the modes B and D, only the black toner is carried on the drum 50 or it is desired to transfer only the black toner to the paper sheet 30. In this operation mode, it is needless to activate the precharger 36 and, thus, the voltage supply to the charge wire was turned OFF. (Though various methods are available to substantially prevent corona ions from reaching the drum 50 while maintaining the voltage supply turned ON, as such would invite various problems as intricacy of construction.) The transfer charger 34 was impressed with a voltage opposite in polarity to the toner, i.e. negative voltage.

In the operation modes A–E, the image density and sheet separability were found dependent on the voltage applied to the conductive member 38 as represented by a curve in FIG. 7. It will be seen from FIG. 7 that the voltage fed to the conductive member 38 should preferably be −600 V or higher in order to ensure transfer of favorable images but −200 V or lower in order to ensure stable sheet separation. Due to such a difference in desirable voltage, it was confirmed preferable to ground the conductive member 38 upon contact of a leading end of a paper sheet 30 with the conductive member 38, apply a voltage of −600 V or higher to the conductive member 38 after the leading end of the sheet has advanced 5 mm past the conductive member 38, and maintain said voltage until the trailing end of the sheet moves clear of the conductive member 38.

In the modes C and E, only the red toner is carried on the drum 50 or is intended to be transferred onto a paper sheet. Hence, the elements 36, 34 and 38 were controlled in the same way as in the modes B and D except for the polarities as shown in the table.

In this manner, in Example III, the individual elements 36, 34 and 38 were selectively operated in accordance with an operation mode to achieve good image transfer and sheet separation.

EXAMPLE IV

This Example used the same apparatus as in Examples II and III to pick up desired video data. While in Example III all or part of the elements 36, 34 and 38 for image transfer and sheet separation were controllably switched in operation or the conditions were varied each depending on the mode of operation, in Example IV all the elements 36, 34 and 38 were kept operative throughout the five operation modes A–E and operated under common conditions. This made it needless to turn on or off the individual elements or change the voltages supplied thereto or their polarities depending on the operation mode, resulting in a simple construction, a cut-down in cost and an improvement in reliability.

In detail, the mode A is a mode wherein latent images are developed with two different colors of toners to obtain the different video data at the same time in different colors and, therefore, it is the same as one described in Example II. Example III is common to Example II concerning the conditions for the formation and development of latent images, and the voltages and polarities applied to the precharger, transfer charger and conductive member.

In the modes B, C, D and E, it was revealed that image transferability and sheet separability comparable with those in the mode A are achievable under exactly the same conditions. In the modes C and E, for example, it was possible to invert the polarity of the red toner once to the positive and thereby transfer toner images and separate a sheet under the same conditions as in the mode A. As for the modes B and D, desirable images were obtained under exactly the same conditions as in the mode A.

Thus, in Example IV, the three elements for image transfer and sheet separation, i.e., the precharger 36, transfer charger 34 and conductive member 38 were operated under common conditions throughout the five different operation modes to achieve images of desirable quality on copy sheets.

It will be appreciated from the Examples and Comparative Examples described so far that the arrangement shown in FIG. 5 constitutes an excellent transfer and separation apparatus due to the combination of the precharger, transfer charger and conductive member with a voltage supplying means.

Various modifications will become possible for those skilled in the art after receiving the teachings of the present disclosure without departing from the scope thereof.

What is claimed is:

1. An image transfer and sheet separation apparatus for an electrophotographic system, comprising:

(a) a photoconductive member on which a latent image is to be formed electrostatically;

(b) developing menas for developing the latent image with a toner into a toner image;

(c) a transfer charging means for transferring the toner image onto a transfer medium;

(d) a precharging means located between the developing means and the transfer charging means; and (e) a conductive member so positioned downstream of the transfer charging means as to be intimately engaged by the transfer medium, the conductive member being moved in a same direction and at a same speed as the transfer medium at a point of engagement therewith.

2. An apparatus as claimed in claim 1, in which the conductive member comprises a conductive belt.

3. An apparatus as claimed in claim 1, in which the conductive member comprises a conductive roller.

4. An apparatus as claimed in claim 1, further comprising a means for supplying a voltage to the conductive member.

5. An apparatus as claimed in claim 1, in which the transfer charging means comprises a scorotron.

6. An apparatus as claimed in claim 1, in which the precharging means is supplied with a voltage common in polarity to a polarity of charge on the toner image.

7. An apparatus as claimed in claim 4, in which the voltage supply means supplies the conductive member with a voltage whose polarity is opposite to that of a voltage applied to the transfer charging means.

8. An image transfer and sheet separation apparatus for an electrophotographic system, comprising:

(a) a latent image supporting member on which latent images of opposite polarities are to be formed electrostatically;

(b) developing means for successively developing the latent images with two different kinds of toners which are charged to opposite polarities, thereby forming toner images of opposite polarities on the latent image supporting member;

(c) a precharging means for charging the toner images to uniformalize their polarities to selected one;

(d) a transfer charging means for transferring the toner images of the uniformalized polarity onto a transfer medium; and (e) a conductive member so located to be intimately engaged by the transfer medium.

9. An apparatus as claimed in claim 8, in which the latent image supporting member comprises a photoconductive member.

10. An apparatus as claimed in claim 8, in which the latent image supporting member comprises a dielectric member.

11. An apparatus as claimed in claim 8, in which the transfer charging means comprises a scorotron.

12. An apparatus as claimed in claim 8, further comprising a means for supplying a voltage to the conductive member.

13. An apparatus as claimed in claim 8, in which the conductive member comprises a conductive belt.

14. An apparatus as claimed in claim 13, in which the belt has a thin layer of metal formed on a plastic film.

15. An apparatus as claimed in claim 14, in which the plastic film comprises at least one of a polyester film and a polyimide film, the thin metal layer comprising a thin aluminum layer.

16. An apparatus as claimed in claim 13, in which the belt is made of conductive rubber.

17. An apparatus as claimed in claim 13, in which the belt is made of nickel.

18. An apparatus as claimed in claim 8, in which the conductive member is in the form of a roller.

19. An apparatus as claimed in claim 18, in which the roller has a thin layer of metal formed on a plastic film.

20. An apparatus as claimed in claim 19, in which the plastic film comprises at least one of a polyester film and a polyimide film, the thin metal layer comprising a thin aluminum layer.

21. An apparatus as claimed in claim 18, in which the roller is made of conductive rubber.

22. An apparatus as claimed in claim 18, in which the roller is made of at least one of aluminum and iron.

23. An apparatus as claimed in claim 8, in which the transfer charging means is impressed with a voltage which is opposite in polarity to the uniformalized polarity of the toner images.

24. An image transfer and sheet separation apparatus for an electrophotographic system, comprising:

(a) a latent image supporting member;

(b) imaging means for electrostatically forming latent images on said latent image supporting member;

(c) developing means for developing the latent images into toner images;

(d) a precharging means for uniformalizing the polarities of the toner images to selected one;

(e) a transfer charging means for transferring the toner images of the uniformalized polarity onto a transfer medium;

(f) a conductive member so located as to be intimately engaged by the transfer medium; and (g) control means for controlling the imaging means and the developing means to selectively operate in three different modes: mode I wherein the imaging means form electrostatic latent images of opposite polarities on the latent image supporting member while the developing means successively develop the individual latent images with toners which are charged to opposite polarities, mode II wherein the imaging means form latent images of either one polarity on the latent image supporting member while the developing means develop the latent images with a toner which is charged to either one polarity, and mode III wherein the imaging means form latent images of opposite polarities on the latent image supporting member while the developing means develop the latent images with a toner which is charged to either one polarity.

25. An apparatus as claimed in claim 24, in which the control means provides a control such that in the mode I voltages are supplied to the precharging means, the transfer charging means and the conductive member and, in the modes II and III, the voltage supply to the precharging means is cut off while the polarities of the voltages supplied to the transfer charging means and the conductive member are varied in accordance with a polarity of the toner image or images.

26. An apparatus as claimed in claim 24, in which the control means provides a control such that the precharging means, the transfer charging means and the conductive member are supplied with voltages which are common in polarity throughout the different operation modes.

* * * * *